US009029307B2

(12) United States Patent
Beatty et al.

(10) Patent No.: US 9,029,307 B2
(45) Date of Patent: May 12, 2015

(54) THICKENED GREASE COMPOSITION

(75) Inventors: Richard P. Beatty, Newark, DE (US); Denis John Smit, Middlesbrough (GB)

(73) Assignee: INVISTA North America S.a r.l., Wilmington, DE (US)

( * ) Notice: Subject to any disclaimer, the term of this patent is extended or adjusted under 35 U.S.C. 154(b) by 103 days.

(21) Appl. No.: 13/885,189

(22) PCT Filed: Dec. 14, 2011

(86) PCT No.: PCT/US2011/064900

§ 371 (c)(1), (2), (4) Date: Jun. 3, 2013

(87) PCT Pub. No.: WO2012/082890

PCT Pub. Date: Jun. 21, 2012

(65) Prior Publication Data

US 2014/0303052 A1 Oct. 9, 2014

Related U.S. Application Data

(60) Provisional application No. 61/423,719, filed on Dec. 16, 2010, provisional application No. 61/446,079, filed on Feb. 24, 2011.

(51) Int. Cl.

| | |
|---|---|
| ***C10M 113/00*** | (2006.01) |
| ***C10M 117/00*** | (2006.01) |
| ***C10M 117/04*** | (2006.01) |
| ***C10M 169/02*** | (2006.01) |
| ***C10M 141/02*** | (2006.01) |
| *C10M 129/72* | (2006.01) |
| *C10M 129/76* | (2006.01) |

(52) U.S. Cl.

CPC ..... *C10M 141/02* (2013.01); *C10M 117/00* (2013.01); *C10M 2203/1025* (2013.01); *C10M 2207/022* (2013.01); *C10M 2207/123* (2013.01); *C10M 2207/128* (2013.01); *C10M 2207/1285* (2013.01); *C10M 2207/281* (2013.01); *C10M 2207/282* (2013.01); *C10M 2207/289* (2013.01); *C10N 2210/01* (2013.01); *C10N 2250/10* (2013.01); *C10N 2270/00* (2013.01); *C10M 129/72* (2013.01); *C10M 129/76* (2013.01); *C10M 2201/062* (2013.01); *C10M 2207/28* (2013.01)

(58) Field of Classification Search

CPC ..... C10M 169/02; C10M 169/06; C10M 123/00; C10M 123/02; C10M 123/04; C10M 1275/0083; C10M 2201/006; C10M 115/04; C10M 117/00; C10M 117/02; C10M 117/04; C10M 117/06; C10M 117/08; C10M 117/10

USPC ..... 508/178, 212, 519

See application file for complete search history.

(56) References Cited

U.S. PATENT DOCUMENTS

| | | | | |
|---|---|---|---|---|
| 2,614,076 | A | 10/1952 | Moore et al. | |
| 2,614,077 | A | 10/1952 | Moore et al. | |
| 2,940,930 | A * | 6/1960 | Sproule et al. | 508/455 |
| 3,985,662 | A | 10/1976 | Campbell et al. | |
| 4,410,435 | A | 10/1983 | Naka et al. | |
| 4,737,299 | A | 4/1988 | Grasshoff et al. | |
| 5,391,309 | A * | 2/1995 | Brewster et al. | 508/512 |
| 7,829,512 | B2 * | 11/2010 | Stober et al. | 508/512 |
| 2005/0082014 | A1 * | 4/2005 | Spagnoli et al. | 159/23 |

FOREIGN PATENT DOCUMENTS

| | | | |
|---|---|---|---|
| CN | 101481637 | A | 7/2009 |
| CN | 101880583 | A | 11/2010 |
| EP | 0084910 | A2 | 8/1983 |
| GB | 701637 | | 12/1953 |
| JP | 59-199797 | A | 11/1984 |
| WO | 2012/082890 | A1 | 6/2012 |

OTHER PUBLICATIONS

International Search Report and Written Opinion received for PCT Application No. PCT/US2011/64900, mailed on Apr. 2, 2012, 10 pages.

International Preliminary Report on Patentability received for PCT Patent Application No. PCT/US2011/64900, mailed on Mar. 4, 2013, 8 pages.

* cited by examiner

*Primary Examiner* — Pamela H Weiss

(74) *Attorney, Agent, or Firm* — Ni Yan

(57) ABSTRACT

A thickened grease composition is provided by process of heating a mineral oil and 12-hydroxystearic acid with lithium hydroxide and forming a simple lithium grease to which at least one component selected from the group comprising succinic acid, glutaric acid, adipic acid, 6-hydroxycaproic acid, dimethyl succinate, dimethyl glutarate, dimethyl adipate, methyl hydroxycaproate, cyclohexanediols, methyl 5-hydroxyvalerate, methyl valerate, gamma butyrolactone, and methyl levulinate or mixtures thereof.

7 Claims, No Drawings

THICKENED GREASE COMPOSITION

CROSS-REFERENCE TO RELATED APPLICATIONS

This application claims priority from U.S. Provisional Applications Ser. Nos. 61/423,719 filed on Dec. 16, 2010 and 61/446,079 filed on Feb. 24, 2011.

FIELD OF THE INVENTION

This disclosure relates to greases and thickened greases. More specifically, a thickened grease composition with performance properties intermediate to those of simple lithium greases and complex lithium greases.

BACKGROUND OF THE INVENTION

Simple lithium grease and lithium complex grease are well known greases in the art. They are the most common type of greases in use and have widespread industrial utility and a good multi-purpose versatility. It has been estimated that lithium greases account for about half of the total grease market.

Currently, an issue in the market for grease is the demand for greases with better performance than simple lithium greases. Attributes of grease performance particularly sought are improvements in mechanical and thermal stability. This demand for higher performance is currently met by lithium complex greases, see for example U.S. Pat. No. 4,410,435; Naka et al.

Lithium complex greases possess many of the properties of simple lithium soap greases and also have higher dropping points, allowing the greases to be used at higher temperatures. The dropping point of lithium complex greases is higher than that of simple lithium soap greases due to the presence of a second thickener component, known as a complexing agent. Modern lithium complex greases typically use a shorter chain-length difunctional carboxylic acid, such as azelaic acid or adipic acid. The lithium salt of these materials is typically present in a significantly lower proportion compared to the simple lithium soap thickener. An alternate material used as a complexing agent is boric acid. The use of this material also results in an elevated dropping point.

Due to their improved performance properties, Lithium complex greases can be significantly more expensive to produce that simple lithium greases. Therefore, there is currently a need for lithium grease of performance intermediate to that of a simple lithium grease and a lithium complex grease.

SUMMARY OF THE INVENTION

The present invention relates to a thickened lithium grease with performance properties that lie within those of simple lithium greases and complex lithium greases. The thickened grease herein described, comprises a mixture of acids and esters and provides improvements to drop point, mechanical stability, roll stability and oil separation loss over simple lithium grease. An embodiment of the present invention comprises:

a) a first component comprising a mineral or synthetic oil;
b) lithium hydroxide; and
c) a second component selected from a group comprising succinic acid, glutaric acid, adipic acid, 6-hydroxycaproic acid, dimethyl succinate, dimethyl glutarate, dimethyl adipate, methyl hydroxycaproate, cyclohexanediols, methyl 5-hydroxyvalerate, methyl valerate, gamma butyrolactone, and methyl levulinate or mixtures thereof.

In another embodiment, the second component comprises from about 10 to about 60 wt % methyl hydroxycaproate, about 20 to about 95% dimethyl adipate, about 1 to about 10 wt % dimethyl glutarate, about 0.1 to about 5 wt % dimethyl succinate, about 0.1 to about 7 wt % cyclohexanediols, about 0.01 to about 7 wt % methyl 5-hydroxyvalerate, about 0.01 to about 5 wt % gamma butyrolactone, and about 0.01 to about 10 wt % methyl levulinate.

In another embodiment, the first component additionally comprises 12-hydroxystearic acid.

In another embodiment, the 12-hydroxystearic acid is provided in an amount from about 5 to about 99.5 wt % of the grease composition.

In another embodiment, the lithium hydroxide is added in a less than stoichiometric amount with the second component.

In another embodiment, the second component has an acid number of about 0.07 mg KOH/g, a water content of about 0.04 wt % and a hydroxyl number of about 257 KOH/g.

In another embodiment, the product mixture has a drop point temperature performance of about 180° C. to about 250° C.

In another embodiment, the grease composition of any of the above claims may be formed by the steps of:

a) heating the first component to a range between about 85° C. to about 90° C. and maintaining a liquidus temperature for the first component;
b) adding an aqueous slurry of lithium hydroxide and evaporating the aqueous content to form a heated mixture;
c) mixing the second component with the heated mixture to form a neutralized mixture, wherein the second component contains terminal hydroxyl groups which act to oligomerize the neutralized mixture;
d) heating the neutralized mixture to about 210° C. so that vaporized methyl alcohol and a grease composition is recovered; and
e) cooling and isolating the grease composition.

DETAILED DESCRIPTION OF THE INVENTION

The present invention relates to thickened lithium grease with performance properties that lie within those of simple lithium greases and complex lithium greases. The thickened lithium grease contains a thickening component selected from a group comprising succinic acid, glutaric acid, adipic acid, 6-hydroxycaproic acid, dimethyl succinate, dimethyl glutarate, dimethyl adipate, methyl hydroxycaproate, cyclohexanediols, methyl 5-hydroxyvalerate, methyl valerate, gamma butyrolactone, and methyl levulinate or mixtures thereof.

All patents, patent applications, test procedures, priority documents, articles, publications, manuals, and other documents cited herein are fully incorporated by reference to the extent such disclosure is not inconsistent with this invention and for all jurisdictions in which such incorporation is permitted.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

The term "liquidus temperature", as used herein unless otherwise indicated, refers to the temperature above which, the heated first component behaves as a liquid.

The term "acid number", as used herein unless otherwise indicated, refers to the quantity of base, expressed in milligrams of potassium hydroxide (KOH), that is required to neutralize the acidic constituents in one gram of sample The term "hydroxyl number", as used herein unless otherwise indicated, refers to the number of milligrams KOH which are equivalent to one gram of sample According to a particular embodiment of the current invention, a thickened lithium grease composition is formed by the steps of first providing a mixture of first components comprising a mineral oil or synthetic oil. Any mineral oil, synthetic hydrocarbon oil or synthetic ester oil known in the art may be used. The first component may also contain 12-hydroxystearic acid. The first component may then be heated to a range from about 85° C. to about 90° C. while mixing and maintaining a temperature to melt the 12-hydroxystearic acid.

Next, the aqueous content is evaporated and an aqueous slurry of lithium hydroxide is added to form a heated mixture. The heated mixture is maintained at a substantially constant temperature, thereby forming a simple lithium grease. In the embodiments herein, lithium hydroxide is added in less than stoichiometric amounts, in relation to the second component. It has been found through experimentation that adding a less than stoichiometric amount of Lithium hydroxide, acts to oligomerize the second component and thicken the subsequently formed mixture.

A second component, which is capable of substantially neutralizing the lithium hydroxide in the mixture, is then added to the heated mixture to form a neutralized mixture. The second component may be selected from the group comprising succinic acid, glutaric acid, adipic acid, 6-hydroxycaproic acid, dimethyl succinate, dimethyl glutarate, dimethyl adipate, methyl hydroxycaproate, cyclohexanediols, methyl 5-hydroxyvalerate, methyl valerate, gamma butyrolactone, and methyl levulinate or mixtures thereof. The neutralized mixture is then heated to about 210° C. and maintained at that temperature to substantially liberate the water and the methanol so-formed. Finally, the remaining mixture is cooled to isolate the grease composition.

In a particular embodiment, the second component comprises an ester composition that includes about 40 wt % methyl hydroxycaproate and about 27 wt % dimethyl adipate. In addition, the ester composition can include about 3 wt % dimethyl glutarate, about 0.5 wt % dimethyl succinate, about 4 wt % cyclohexanediols, about 4 wt % methyl 5-hydroxyvalerate, about 2 wt % methyl valerate, about 2 wt % valerolactone, and about 0.7 wt % methyl levulinate. In a particular embodiment of the current invention, the ester composition can have an acid number of about 0.07 mg KOH/g, a water content of about 0.04 wt %, and a hydroxyl number of about 257 mg KOH/g.

Table 1, below, shows concentration ranges, in weight percent, for ester compositions within the scope of the disclosure. Higher or lower concentrations of certain components (e.g., dimethyl adipate, methyl hydroxycaproate, and the like) can be obtained by selective product isolation. In an embodiment, for each concentration range A-E noted in Table 1, the components other than methyl hydroxycaproate and dimethyl adipate can optionally be present. For example, an embodiment of the ester composition includes about 10 to 60 weight % of methyl hydroxycaproate and about 20 to 80 dimethyl adipate. In another example, an embodiment of the ester composition includes about 15 to 50 weight % of methyl hydroxycaproate and about 30 to 70 weight % dimethyl adipate. In any of the embodiments disclosed herein or the embodiments shown in Table 1, the composition may contain less than about 20 wt % oligomeric esters. For example the composition may contain about 0.001 to 20 wt %, about 0.001 to 14 wt %, or about 0.001 to 10 wt % oligomeric esters. It is understood to be within the scope of the invention to select a concentration from any one column of Table 1 in combination with concentrations from any other columns of Table 1 provided that the sum of the concentrations is less than or equal to 100 wt %. Any of the compositions may contain less than about 5 wt % methyl valerate (e.g., about 0.01 to about 5 wt %, about 0.01 to 3 wt %, 0.01 to 1.5 wt %, about 0.01 to 0.1 wt %) and/or less than about 10 wt % valerolactone (e.g., about 0.01 to 10 wt %, about 0.01 to 7 wt %, 0.01 to 4 wt %, 0.01 to 2 wt %).

TABLE 1

| Component | Conc. Range A, wt % | Conc. Range B, wt % | Conc. Range C, wt % | Conc. Range D, wt % | Conc. Range E, wt % |
|---|---|---|---|---|---|
| methyl hydroxycaproate | about 10 to 60 | about 15 to 50 | about 20 to 40 | about 15 to 40 | about 30 to 50 |
| dimethyl adipate | about 20 to 80 | about 30 to 70 | about 35 to 55 | about 30 to 50 | about 20 to 40 |
| dimethyl glutarate | about 1 to 15 | about 2 to 10 | about 3 to 7 | about 4 to 8 | about 1 to 5 |
| dimethyl succinate | about 0.1 to 5 | about 0.25 to 3 | about 0.5 to 2 | about 1 to 2 | about 0.1 to 2 |
| Cyclohexanediols | about 0.1 to 7 | about 0.25 to 5 | about 1 to 3 | about 2 to 4 | about 2 to 6 |
| methyl 5-hydroxyvalerate | about 0.1 to 7 | about 0.25 to 5 | about 1 to 3 | about 0.2 to 2 | about 3 to 5 |
| gamma butyrolactone | about 0.01 to 5 | about 0.01 to 3 | about 0.01 to 2 | about 0.01 to 1 | about 0.01 to 2 |
| methyl levulinate | about 0.01 to 10 | about 0.01 to 7 | about 0.01 to 4 | about 0.01 to 3 | about 0.01 to 4 |

Suitable mixtures of esters include those sold under the trade name DBE®-X, and are commercially available from INVISTA Specialty Intermediates. These mixtures comprise mainly dimethyl adipate and other oxygenated species built around a 6-carbon backbone. Useful mixtures of esters may contain a variety of other esters, hydroxy-compounds and oxygenated components. In one embodiment, the mixture of esters is a DBE®-X brand mixture of esters including: dimethyl adipate (30-95 wt %); dimethyl glutarate (0-10 wt %); dimethyl succinate (0-2 wt %); hydroxyl compounds (0-50 wt %); with a hydroxyl number 100-200 mg KOH/g typical; and an acid number (mg KOH/g) 1.5 typical, 5 max.; and water (wt %) 0.1 typical, 0.5 maximum. In addition, other known complexing agents, such as the methyl ester of dodecanedioc acid, may be used.

The use of a commercially available mixture of esters (such as DBE®-X brand esters) provides at least a convenient and repeatable complexing of the lithium grease. The acid mixture so-formed may be further reacted with other metal ions, e.g., calcium or aluminum, in the form of their hydroxides. Furthermore this mixture of esters lends itself to both batch and continuous processing. Because the methyl ester form of these acids is liquid at low temperature it is in particular well-suited for use in continuous processing.

It is believed, but not by way of limitation, that synergies between the components in the acid mixture aid the formation of a complex, enhancing the processing of the grease to be substantially more uniform in batch-to-batch variation. The processing of these grease compositions lends itself to batch and continuous processing techniques known to the skilled person.

Further according to particular embodiments of the disclosures herein, a soap thickener (12-hydroxystearic acid) is provided to the grease in an amount of about 5 to 15% by weight. In addition, ratios between 12-hydroxystearic acid and the acid mixture range may be varied from blends containing substantially no 12-hydroxystearic acid to blends of about 99.5% by weight 12-hydroxystearic acid.

A further advantage of this ester mixture is that it provides both thickening and partial complexing capability. In the case of the "drop point" temperature performance, an adjustable range of between that of a simple lithium grease (typically 180° C.) and a lithium complex grease (typically >250° C.) is achievable.

EXAMPLES

The following Examples demonstrate the present invention and its capability for use. The invention is capable of other and different embodiments, and its several details are capable of modifications in various apparent respects, without departing from the scope and spirit of the present invention. Accordingly, the Examples are to be regarded as illustrative in nature and non-limiting.

The drop-point can be tested using ASTM D2265-06 standard test methods for dropping point of lubricating grease over wide temperature range. The mechanical stability can be tested using ASTM D217A/B/D; cone penetration of lubricating Grease. The roll stability can be tested using ASTM D1831-00 (2006) and the oil separation loss can be tested using ASTM D1742-06 oil separation during storage.

Example 1

In an example of the preparation of the lithium grease composition of the current invention, a stirred batch grease kettle is fitted with an overhead condenser and charged with 10 kg of ISO 32 hydrocracked mineral oil and 0.6 kg of 12-hydroxystearic acid. This mixture is then heated to 90° C. and a heated slurry containing lithium hydroxide monohydrate is added to exactly neutralize the mixture. Once most of the water is evaporated, 0.6 kg of DBE®-X ester a mixture of esters having the composition shown as range "C" in Table 1) is added. The DBE®-X ester comprises 21% methyl 6-hydroxycaproate, 55% dimethyl adipate, 5% dimethyl glutarate, 1% dimethyl succinate, and 1% methyl levulinate, This step is followed by the slow addition of a further lithium hydroxide monohydrate slurry, as needed, to neutralize the mixture.

This resulting mixture is held at this temperature until most of the water and methanol is removed and then gradually heated to 210° C. and maintained at this temperature for 15 minutes. During the final heating stage, residual methanol and water is liberated overhead and condensed.

The product, a lithium complex grease, is cooled over a 1 hour period to 80° C. and is milled before being discharged into suitable containers.

Examples 2-6

The procedure of Example 1 can be repeated with different mixtures of esters as shown below in Table 2. In each of the examples, the resultant grease composition can be tested by the methods listed above. Using these formulations and the method of preparation described above, the drop point ranges for the resultant grease compositions of about 180° C. to about 250° C. can be achieved.

TABLE 2

| Component | Example 2 wt % | Example 3 wt % | Example 4 wt % | Example 5 wt % | Example 6 wt % |
|---|---|---|---|---|---|
| methyl hydroxycaproate | 34 | 32 | 30 | 23 | 50 |
| dimethyl adipate | 50 | 40 | 50 | 45 | 45 |
| dimethyl glutarate | 6 | 4 | 5 | 7 | 1.7 |
| dimethyl succinate | 2 | 4 | 1 | 3 | 0.1 |
| Cyclohexanediols | 2 | 5 | 4 | 4 | 2 |
| methyl 5-hydroxyvalerate | 2 | 5 | 5 | 3 | 3 |
| gamma butyrolactone | 2 | 4 | 3 | 2 | 0.1 |
| methyl levulinate | 2 | 6 | 2 | 3 | 0.1 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also the individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±8%, or ±10%, of the numerical value(s) being modified. In addition, the phrase "about 'x' to 'y'" includes "about 'x' to about 'y'".

While the illustrative embodiments of the invention have been described with particularity, it will be understood that the invention is capable of other and different embodiments and that various other modifications will be apparent to and may be readily made by those skilled in the art without departing from the spirit and scope of the invention. Accordingly, it is not intended that the scope of the claims hereof be limited to the examples and descriptions set forth herein but rather that the claims be construed as encompassing all the features of patentable novelty which reside in the present disclosure, including all features which would be treated as equivalents thereof by those skilled in the art to which the invention pertains.

The invention claimed is:

1. A grease composition comprising:

a) a first component comprising a mineral or synthetic oil;

b) lithium hydroxide; and c) a second component comprising from about 10 to about 60 wt. % methyl hydroxycaproate, about 20 to about 95 wt. % dimethyl adipate, about 1 to about 10 wt. % dimethyl glutarate, about 0.1 to about 5 wt. % dimethyl succinate, about 0.1 to about 7 wt. % cyclohexanediols, about 0.01 to about 7 wt. % methyl 5-hydroxyvalerate, about 0.01 to about 5 wt. % gamma butyrolactone, and about 0.01 to about 10 wt. % methyl levulinate.

2. The grease composition of claim 1, wherein the first component additionally comprises 12-hydroxystearic acid.

3. The grease composition of claim 2, wherein the 12-hydroxystearic acid is provided in an amount from about 5 to about 99.5 wt % of the grease composition.

4. The grease composition of claim 1, wherein the lithium hydroxide is added in a less than stoichiometric amount with the second component.

5. The grease composition of claim 1, wherein the second component has an acid number of about 0.07 mg KOH/g, a water content of about 0.04 wt % and a hydroxyl number of about 257 KOH/g.

6. The grease composition of claim 1, wherein the product mixture has a drop point temperature performance of about 180° C. to about 250° C.

7. The grease composition of any one of claims 1 or 2-6 formed by the steps of:

a) heating the first component to range between about 85° C. to about 90° C. and maintaining a liquidus temperature for the first component;

b) adding an aqueous slurry of lithium hydroxide and evaporating the aqueous content to form a heated mixture;

c) mixing the second component with the heated mixture to form a neutralized mixture, wherein the second component contains terminal hydroxyl groups which act to oligomerize the neutralized mixture;

d) heating the neutralized mixture to about 210° C. so that vaporized methyl alcohol and a grease composition is recovered; and e) cooling and isolating the grease composition.

* * * * *